United States Patent [19]

Frederick

[11] 4,203,374

[45] May 20, 1980

[54] METHOD AND MEANS FOR BURNING CORNCOBS AND CORN

[76] Inventor: Charles V. Frederick, Rte. #5, New Virginia, Iowa 50219

[21] Appl. No.: 924,995

[22] Filed: Jul. 17, 1978

[51] Int. Cl.[2] ..... F23G 7/00

[52] U.S. Cl. ..... 110/258; 110/259; 110/255; 110/248; 110/291; 110/346

[58] Field of Search ..... 110/258, 259, 235, 248, 110/255, 291, 346, 247, 217

[56] References Cited

U.S. PATENT DOCUMENTS

| | | | |
|---|---|---|---|
| 607,553 | 7/1898 | Smead | 110/255 |
| 2,240,702 | 5/1941 | King | 110/247 X |
| 3,608,278 | 9/1971 | Greenspan | 110/217 |
| 4,043,280 | 8/1977 | Wray et al. | 110/258 |

*Primary Examiner*—Edward G. Favors

*Attorney, Agent, or Firm*—Zarley, McKee, Thomte, Voorhees & Sease

[57] ABSTRACT

A method and means for burning corn and corncobs is described. The apparatus includes a conical or pyramidal shaped perforated floor having a central opening formed therein which is in communication with a first conveyor which supplies the material to be burned thereto. A second conveyor extends around the periphery of the floor for carrying away the ashes of the burned material. The first conveyor forces the corncobs or corn upwardly through the central opening to form a mound or pile of material thereon. The mound of material is ignited and air is forced upwardly through the perforated floor to enhance combustion so that the material is substantially completely burned. The products of combustion are passed upwardly through a heat exchanger and filtered through the material delivered to the first conveyor before being exhausted to the atmosphere.

15 Claims, 3 Drawing Figures

METHOD AND MEANS FOR BURNING CORNCOBS AND CORN

BACKGROUND OF THE INVENTION

This invention relates to an improved method and means for burning corn and corncobs.

It is a difficult task to burn corncobs after the corn has been removed therefrom. It is desirable to burn the corncobs so as to reduce the volume thereof to enable convenient disposal of the same. A problem associated with the burning of corncobs is that the burning corncobs tend to pollute the atmosphere. It is also difficult to completely burn the corncobs so as to sufficiently reduce the volume thereof. In other words, if the cobs are not sufficiently burned, the resulting ash will occupy almost as much space as the cobs themselves.

In the seed corn industry, approximately ten percent of the seed corn is not able to be planted and the excess seed must be disposed of in some manner. The seed cannot be fed to cattle or the like since chemicals have been applied thereto during the treatment of the same. Thus, the seed corn must also be burned in a manner without polluting the atmoshpere or without creating an undue volume of ash.

Therefore, it is a principal object of the invention to provide an improved method and means for burning corncobs and/or corn.

A still further object of the invention is to provide a method and means for burning corncobs and corn which does not pollute the atmosphere.

A still further object of the invention is to provide a method and means for burning corncobs and corn which does not result in an unduly large amount of resultant ash.

A still further object of the invention is to provide a method and means for burning corn and corncobs which permits the heating of other buildings with the products of combustion.

A still further object of the invention is to provide a method and means for burning corn and corncobs which is convenient.

These and other objects will be apparent to those skilled in the art.

SUMMARY OF THE INVENTION

A conical-shaped perforated floor is positioned within an enclosure and has a central opening formed therein which is in communication with the source of material to be burned. The material to be burned is forced upwardly through the central opening in the floor and is deposited on the perforated floor. The material is ignited and air is forced upwardly through the perforated floor so as to enhance the combustion of the material. The material tends to be deposited upon the floor in a mound and slowly moves downwardly over the floor in a glacier-like fashion towards the periphery. The material burns as it moves downwardly over the floor so that only ash remains when the material reaches the periphery of the floor. A conveyor extends around the periphery of the floor for conveying the ash therefrom. Air carrying the products of combustion is passed upwardly through a heat exchanger so that outlying buildings may be heated. The air is then filtered through incoming material to be burned and the filtered air is passed upwardly through the enclosure by means of an exhaust pipe or the like.

DESCRIPTION OF THE PREFERRED EMBODIMENT

Figure 1:
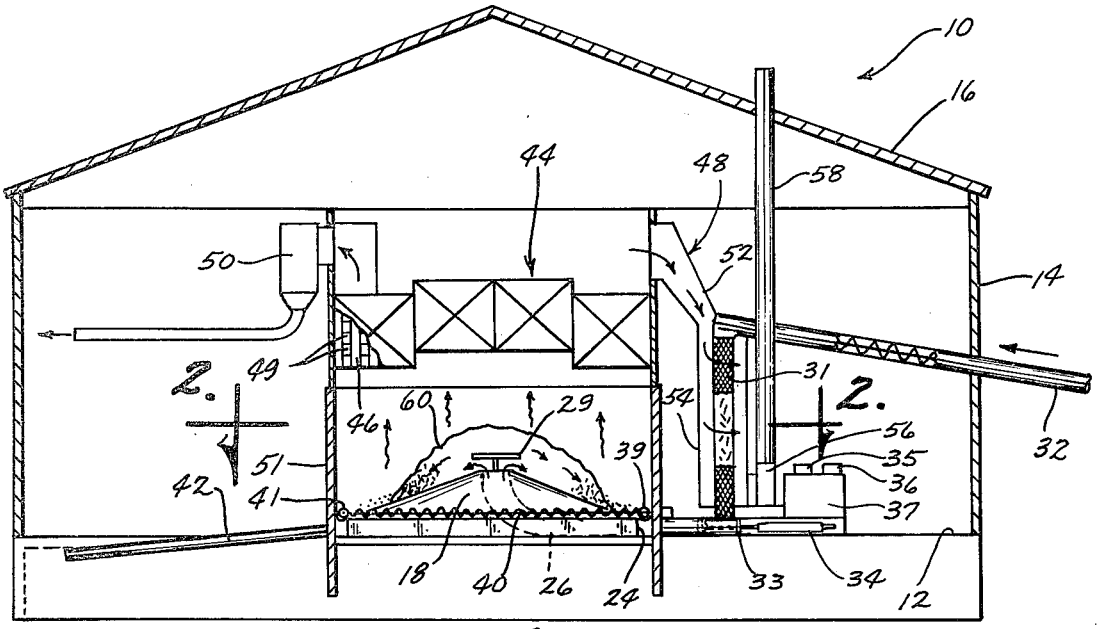
FIG. 1 is a side view illustrating the apparatus of this invention being employed to burn corn or corncobs.

In FIG. 1, the numeral 10 refers to a building which preferably encloses the apparatus employed in this invention. Building 10 includes a floor 12, sidewalls 14 and roof 16.

The numeral 18 refers to a perforated conical-shaped or pyramidal-shaped floor 18 having a central opening 20 formed therein. The numeral 24 refers to a peripheral support for maintaining the periphery 22 of the floor 18 above the floor 12.

Conveyor 26 extends beneath floor 18 and has the intake end thereof in communication with a source of material to be burned and the discharge end thereof in communication with the center opening 20. A shaft 27, driven by motor 28, extends upwardly through the discharge end of conveyor 26 and central opening 20. The numeral 29 refers to a sweep bar means which is secured to the shaft 27 for rotation therewith. The intake end of conveyor 26 is provided with an opening 30 in communication with an upright conveyor tube 31 having a top intake end in communication with a conveyor 32 extending into the building 10 and which is in communication with a source of cobs or corn.

Figure 3:
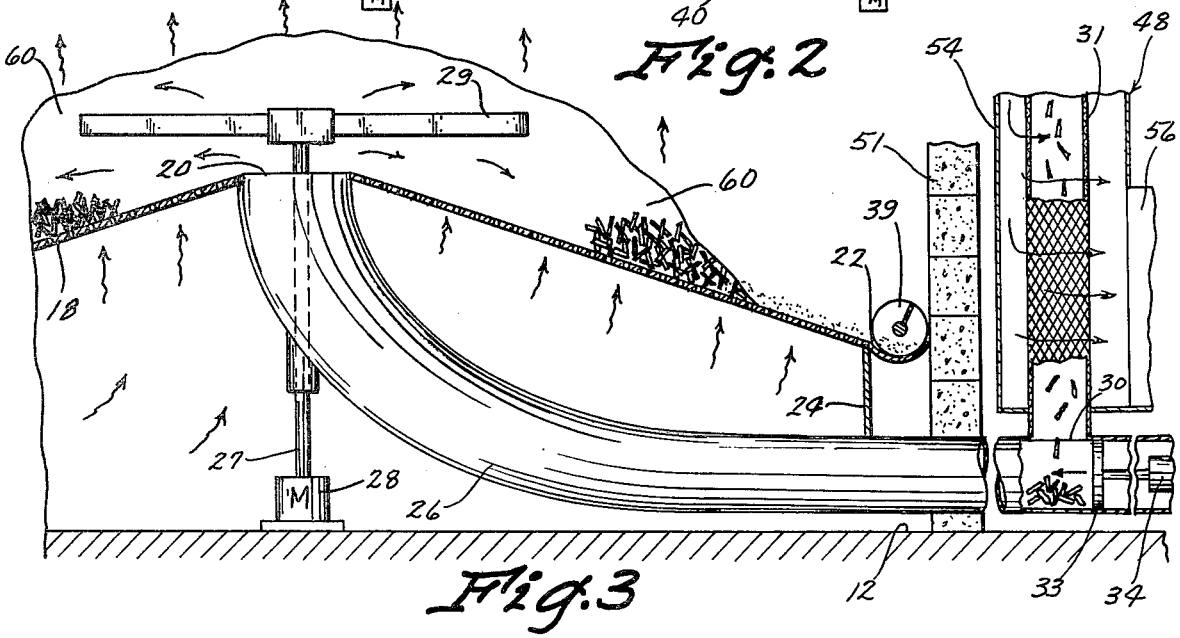
FIG. 3 is an enlarged sectional view seen on lines 3—3 of FIG. 2.

Material is moved thorugh conveyor 26 by a piston 33 reciprocally movable within the intake end of conveyor 26 between the solid line position in FIG. 3 in clearance relation to opening 30 and the dotted line position wherein the piston closes opening 30. Note that conveyor 26 is of slightly increasing diameter toward the discharge end to facilitate the passage of material therethrough. The piston is reciprocally moved by a hydraulic cylinder 34 operatively connected to a fluid pump 35 which is driven by a motor 36 for pumping fluid to the cylinder from a tank 37 in the usual manner for hydraulic drive systems.

Figure 2:
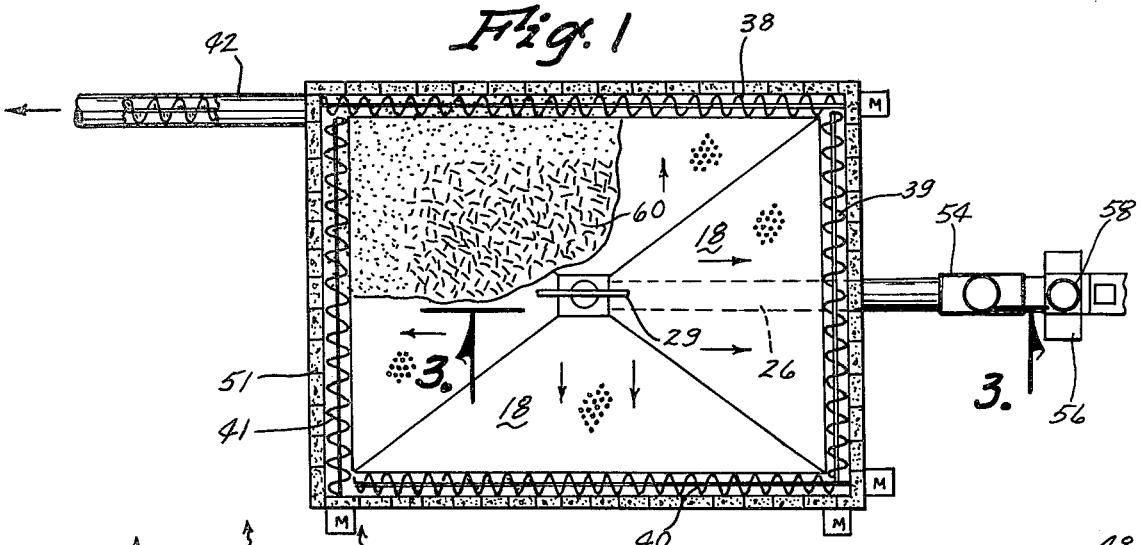
FIG. 2 is an enlarged sectional view seen on lines 2—2 of FIG. 1.

Air is preferably forced upwardly through the perforated floor 18 by any convenient means such as with a conventional blower or fan. Conveyors 38, 39, 40 and 41 extend around the periphery of the floor 18 in the manner illustrated in FIGS. 2 and 3 and are adapted to receive the ashes from the burning material and to convey the same to the ash conveyor 42 which extends outwardly therefrom as illustrated in FIGS. 1 and 2. The numeral 44 refers to a heat exchanger means positioned above the floor 18 and which includes a plurality of vertical conduits 46 which permit the products of combustion to pass upwardly therethrough for passage to a filtering unit 48. A plurality of horizontal conduits 49 extend around the vertical conduits 46 and are in communication with blower 50 for forcing the heated air to remote buildings. As seen in the drawings, a wall or enclosure 51 extends around the floor 18.

The filtering unit 48 includes an intake duct 52 in communication with the interior of enclosure 51 above the heat exchanger 44. Intake duct 52 communicates with an upright duct 54 in which the conveyor tube 31 is centrally supported. Conveyor tube 31 is formed of a perforated or screen material to allow the passage of exhaust air through the tube and material within the tube. The exhaust air is drawn through the filtering unit 48 by a blower 56 and exhausted through a stack or chimney 58.

In operation, conveyor 32 is actuated to fill the conveyor tube 31 and hydraulic cylinder 34 is actuated so that corn or corncobs are forced upwardly through the central opening 20 and desposited on the floor 18 in a mound referred to generally by the reference numeral 60. The material is ignited by pouring diesel fuel or the like thereon and igniting the same. Combustion of the material is enhanced by forcing air upwardly through the material on the floor 18 so that the material is substantially entirely burned. Conveyor 32 is periodically activated by a timer to maintain the conveyor tube 31 substantially full. Hydraulic cylinder 34 is operated in a continuous manner so that the material is maintained in the pile or mound as illustrated in the drawings. As material is continuously fed to the opening 20, the material slowly moves downwardly over the floor 18 in almost a glacier-like fashion. The area of greatest combustion is adjacent the lower end of the mound 60 which exhibits an almost white-hot appearance. As the material passes downwardly over the floor 18, the product is almost completely consumed and only ash reaches the conveyors 38, 39, 40 and 41 with the volume of the ash being substantially less than the volume of material being burned. The arm 29 rotates with the shaft 28 to enhance the distribution of the material on the floor 18.

The combustion products pass upwardly from the burning pile of material and pass through the heat exchanger so that heat may be supplied by blower 50 to an outlying building or the like. The gases of combustion are filtered through the incoming material in filtering unit 48 and exhausted through stack 58. It has been found that the enhanced combustion of the materials results in very little pollutants being added to the atmosphere.

Thus it can be seen that the method and means accomplishes at least all of the stated objectives.

I claim:

1. A device of the type described, comprising, a support means, a floor means extending over a portion of said support means, said floor means extending upwardly and inwardly from the pripheral portion thereof to an open central portion, a first conveyor means having its intake end in operative communication with the material to be burned and its discharge end in communication with said open central portion for conveying the material to be burned upwardly through said central opening for deposit on said floor means around said central opening in a mound which substantially terminates short of the peripheral portion of said floor means, said floor means including multiple perforations which are large enough to permit the upward flow of air therethrough but small enough to substantially resist the downward passage of material to be burned and ashes therethrough, and a second conveyor means extending around the periphery of said floor means for conveying the ashes of the burned material away from said floor means.

2. The device of claim 1 wherein said floor means is pyramidal shaped.

3. The device of claim 1 wherein means is provided for supplying air to the underside of said floor means.

4. The device of claim 1 wherein means is positioned above said open central portion for evenly distributing said material on the central portion of said floor means.

5. The device of claim 1 wherein a heat exchanger means is positioned above said floor means for providing heat to areas remote from said floor means.

6. The device of claim 1 wherein an upstanding enclosure extends around said floor means.

7. The device of claim 6 wherein products of combustion are carried into the air within said enclosure when material is burned on said floor means, and further comprising means for filtering said air, and means for exhausting filtered air to the atmosphere.

8. The device of claim 1 wherein said material comprises corncobs.

9. The device of claim 1 wherein said material comprises corn.

10. The method of burning particulate combustible material, comprising, supplying a quantity of particulate combustible material to the upper portion of a supporting surface inclined sufficiently to frictionally resist the rapid movement of combustible material downwardly thereover, limiting the quantity of combustible material supplied to said supporting surface, thereby forming said combustible material in a mound which substantially terminates short of the lower periphery of said supporting surface, igniting said combustible material, supplying additional combustible material to the upper portion of said supporting surface and to the ignited material whereby the ignited material is slowly moved downwardly over said supporting surface to concentrate the ignition of said combustible material at the lower periphery thereof as said material moves gradually down said inclined supporting surface.

11. The method of claim 10 wherein air is supplied to said combustible material through said supporting surface.

12. The method of claim 10 wherein the ashes remaining from the combustible material are collected at the lower periphery of the supporting surface.

13. A device of the type described, comprising, a support means, a floor means extending over a portion of said support means, said floor means being perforated and extending upwardly and inwardly from the peripheral portion thereof to an open central portion, a first conveyor means having its intake end in operative communication with the material to be burned and its discharge end in communication with said open central portion for conveying the material to be burned upwardly through said central opening for deposit on said floor means around said central opening, and a second conveyor means extending around the periphery of said floor means for conveying the ashes of the burned material away from said floor means, said floor means being pyramidal shaped, and said second conveyor means comprising first, second, third and fourth auger conveyors extending around the periphery of said floor means.

14. A device of the type described, comprising, a support means, a floor means extending over a portion of said support means, said floor means being perforated and extending upwardly and inwardly from the pripheral portion thereof to an open central portion, a first conveyor means having its intake end in operative communication with the material to be burned and its discharge end in communication with said open central portion for conveyinr the material to be burned upwardly through said central opening for deposit on said floor means around said central opening, and a second conveyor means extending around the periphery of said floor means for conveying the ashes of the burned material away from said floor means, an upstanding enclosure extending around said floor means, products of combustion being carried into the air within said enclosure when material is burned on said floor means, means for filtering said air, means for exhausting filtered air to the atmosphere, a third conveyor means having an intake end in operative communication with the material to be burned and a discharge end in operative communication with the intake end of said first conveyor means, said third conveyor means including opposite perforated sidewalls, and said means for filtering said air including means for directing said air through said opposite perforated sidewalls for depositing said products of combustion onto material in said third conveyor means.

15. The method of burning particulate combustible material, comprising, supplying a quantity of particulate combustible material to the upper portion of a supporting surface inclined sufficiently to frictionally resist the rapid movement of combustible material downwardly thereover, igniting said combustible material, supplying additional combustible material to the upper portion of said supporting surface and to the ignited material whereby the ignited material is slowly moved downwardly over said supporting surface to concentrate the ignition of said combustible material at the lower periphery thereof as said material moves gradually down said inclined supporting surface, and filtering the air above said ignited material by directing the air through the material being supplied to said supporting surface.

* * * * *